United States Patent [19]

Dickson

[11] Patent Number: 4,693,041

[45] Date of Patent: Sep. 15, 1987

[54] SURFACE BLASTING APPARATUS

[75] Inventor: Wayne E. Dickson, Tecumseh, Okla.

[73] Assignee: Dickson Industries, Inc., Tecumseh, Okla.

[21] Appl. No.: 784,532

[22] Filed: Oct. 4, 1985

Related U.S. Application Data

[62] Division of Ser. No. 498,846, May 27, 1983, abandoned.

[51] Int. Cl.[4] ..... B24C 7/00; B24C 9/00

[52] U.S. Cl. ..... 51/424; 51/436; 51/432

[58] Field of Search ..... 51/436, 437, 424–426, 51/432, 438; 222/556, 558, 547, 564

[56] References Cited

U.S. PATENT DOCUMENTS

| | | | |
|---|---|---|---|
| 2,160,436 | 5/1939 | Jones | 222/556 X |
| 3,300,903 | 1/1967 | Kosar | 51/424 X |
| 3,977,128 | 8/1976 | Goff | 51/429 X |
| 4,336,671 | 6/1982 | Nelson | 51/424 |
| 4,376,358 | 3/1983 | Shelton | 51/424 X |
| 4,433,511 | 2/1984 | Swain | 51/424 |

FOREIGN PATENT DOCUMENTS

| | | | |
|---|---|---|---|
| 1539571 | 1/1979 | United Kingdom | 51/424 |

*Primary Examiner*—Frederick R. Schmidt
*Assistant Examiner*—Debra Meislin
*Attorney, Agent, or Firm*—William R. Laney

[57] ABSTRACT

An improved surface blasting apparatus for cleaning a surface to be treated by throwing abrasive against the surface at high velocity, then recovering and cleaning the abrasive for reuse. The abrasive rebounding from the treated surface is directed against a magnetic receiving member around which a quantity of the ferrous abrasive forms a protective envelope, with additional high speed abrasive striking said envelope and consequently losing kinetic energy. Means is provided for removing debris from the abrasive by entraining the debris in a flow of air through the apparatus. The debris is separated from the air stream by cyclonic rotation in a dust collector. An alternate embodiment includes a deflector plate to prevent the undesirable escape of abrasive forward of the apparatus. Another embodiment provides for a weighted roller with sharp spikes protruding radially outwardly therefrom to puncture surface coatings which are difficult to remove by normal blasting procedures. A further embodiment utilizes a belt conveyor to lift the abrasive and carry it back to an abrasive storage compartment for reuse rather than using a rebound directing device.

2 Claims, 8 Drawing Figures

SURFACE BLASTING APPARATUS

This is a division of application Ser. No. 498,846 filed May 27, 1983, abandoned.

BACKGROUND OF THE INVENTION

1. Field of the Invention:

This invention relates to surface cleaning equipment, and more particularly to a surface blasting apparatus which recovers blasting abrasive and debris from the treated surface and provides means for washing the debris from the abrasive.

2. Brief Description of the Prior Art

A number of types of surface blasters have been heretofore devised which recover abrasive and debris from the treated surface and utilize various methods to separate the abrasive and debris, so that the reclaimed abrasive can be reused. Such blasting apparatus generally have a centrifugal blasting wheel which throws abrasive against the surface to be treated, and a rebound corridor to catch the abrasive as it bounces from the treated surface and to direct the abrasive back to an abrasive storage area. Air is drawn through the rebound corridor and passes through the stream of abrasive falling from the exit of the rebound corridor down toward the abrasive storage area. This air flow removes surface debris from the abrasive and carries it to a dust collector. A problem is that this air wash does not provide adequate cleaning of the abrasive, so that frequent stops to manually clean the abrasive are required.

In the previous surface blasters, various methods have been utilized to cause the abrasive to lose kinetic energy as it leaves the rebound corridor. This is generally accomplished by the abrasive striking a surface inside the apparatus with resulting wear to that surface.

Previous surface blasting equipment have also presented problems with removal of dust from the dust collector again resulting in frequent interruptions in service.

Another frequent problem with the equipment heretofore known occurs with durable surface coatings such as epoxy. Prior to the present invention, it was not possible to remove such coatings without severely damaging the surface itself.

BRIEF DESCRIPTION OF THE PRESENT INVENTION

The surface blasting apparatus of the present invention includes a self-propelled hydraulically driven main body driven by a riding operator. The hydraulic power is provided by a hydraulic pump driven by an onboard internal combustion engine, or in an alternate embodiment, by an electric motor.

Abrasive is stored in an internal abrasive storage compartment with an adjustable opening in its lowermost portion. A remotely, hydraulically controlled abrasive control valve is used to open or close the opening to allow the desired amount of abrasive to gravitationally flow therethrough. The abrasive is struck by blades attached to an abrasive batting-type blasting wheel assembly. The blades are detachable and replaceable. The wheel moves at high speed so that the stream of abrasive is projected towards the surface to be treated with great force at an acute angle. The abrasve rebounds from the surface into an upwardly curving rebound corridor. As the abrasive leaves the rebound corridor it strikes a row of vertically disposed magnets which are positioned directly above the abrasive storage compartment. Ferrous abrasive forms an envelope around the magnets, and as further abrasives strikes the envelope, kinetic energy is lost and the abrasive gravitationally falls in a vertical curtain toward the abrasive storage compartment. This envelope also protects the magnets from excessive wear.

Air is drawn into the apparatus to flow through the falling curtain of abrasive to wash the debris from the abrasive. The surface debris is lighter than the abrasive and is carried out in the air stream. The air is pulled through the rebound corridor along with the abrasive, and means are provided for entry of fresh air through a manually controlled valve for additional abrasive cleaning.

The air and debris stream exits the abrasive cleaning area through another manually controlled valve and enters a dust collector. Inside the dust collector the air and debris stream is cyclonically rotated so that the debris is thrown by centrifugal force against the inside diameter of a vertical cylinder, thus losing kinetic energy and falling toward the lower portion of the dust collector. A rotatable auger is located in this lower portion and is used to continually force the collected debris out through a dust dump opening.

Air is drawn through the apparatus by an air suction fan mounted in a towable trailer attached to the rear of the main body of the blaster. A flexible hose connects the discharge opening of the dust collector to the inlet of the suction fan. Additional filters can be provided in the trailer for filtering fine dust which does precipitate out by the cyclonic rotation.

To prevent abrasive from escaping around the blast opening between the apparatus and the surface to be treated a flexible, vertically adjustable seal is provided. To provide further protection for the operator and bystanders a forwardly projecting rebound flap is provided which slides along the surface. Abrasive that forwardly escapes from the apparatus will strike the flap and fall harmlessly to the surface. A magnetic roller can be provided to pickup abrasive which does not rebound up through the rebound corridor.

To remove coatings such as epoxy street or highway marking lines, an alternate embodiment is employed which utilizes a weighted rotor with sharp spikes tO puncture the surface coating. This breaks up the coating so that the subsequent blasting operation will remove the coating.

An alternate method of recovering abrasive from the surface which does not utilize a rebound corridor is also disclosed. The abrasive rebounding from the surface is collected in a receiving compartment where it is picked up by a belt conveyor and lifted above and dropped into the abrasive storage compartment. Another magnetic drum is installed to pick up abrasive from the surface and drop it into the receiving compartment.

DETAILED DESCRIPTION OF A PREFERRED EMBODIMENT OF THE INVENTION

Figure 1:
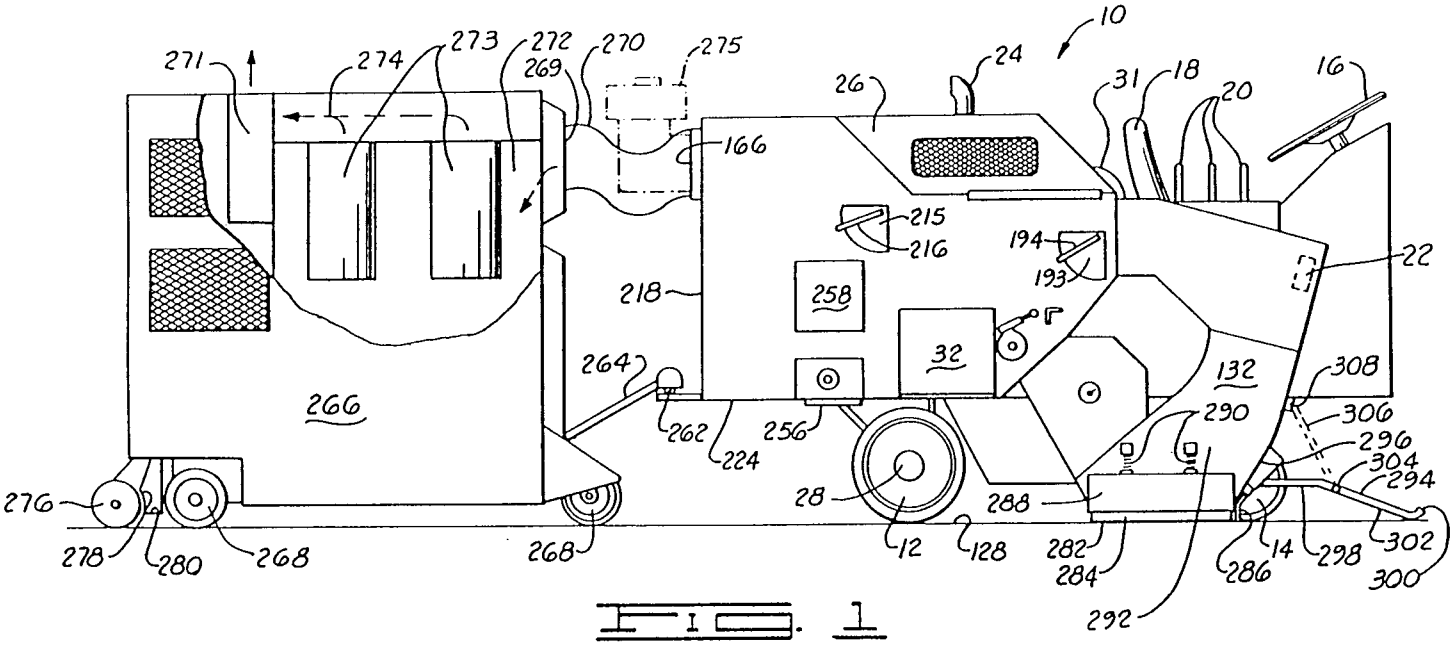
FIG. 1 is an elevation view of the entire surface blasting apparatus of the invention.
Figure 5:
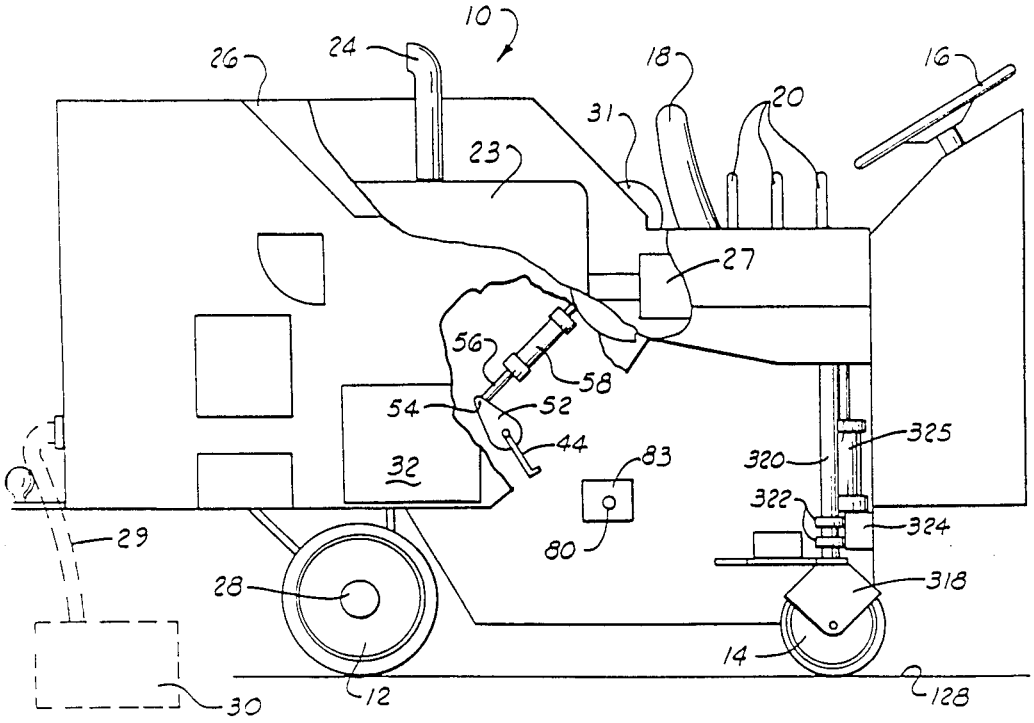
FIG. 5 is a partial cut-a-way of a side elevation of the main body of apparatus.

Referring initially to FIGS. 1 and 5 of the drawings, the surface blasting apparatus of the invention includes a self-propelled main body portion 10 mounted on rear driving wheels 12 and a front wheel 14. A steering wheel 16 controls and turns the front wheel 14 by means of a hydraulically controlled power-steering mechanism (not shown). A driver's seat 18 is positioned immediately to the rear of the steering wheel 16. A plurality of control levers 20 are mounted adjacent the driver's seat 18. A forwardly facing headlamp 22 is mounted on a forward portion of the main body 10. An internal combustion engine 23 with exhaust pipe 24 is positioned to the rear of the driver's seat 18. A removable engine compartment cover 26 is attached to the main body 10 above said internal combustion engine 23. The engine 23 drives a hydraulic pump 27 which in turn provides power to a hydraulic motor and transmission (not shown) which turns rear driving wheels 12 by a central shaft 28 therethrough, the powering steering mechanism and other hydraulic mechanisms hereinafter described. An alternate embodiment of the invention utilizes an electric motor (not shown) to drive the hydraulic pump 27. In such alternate embodiment, power cables 29 would extend from the main body portion 10 to a separate stationary power source 30 not mounted on the apparatus. Other features of the main body portion 10 include a fuel tank 31 and a battery storage compartment 32.

Figure 2:
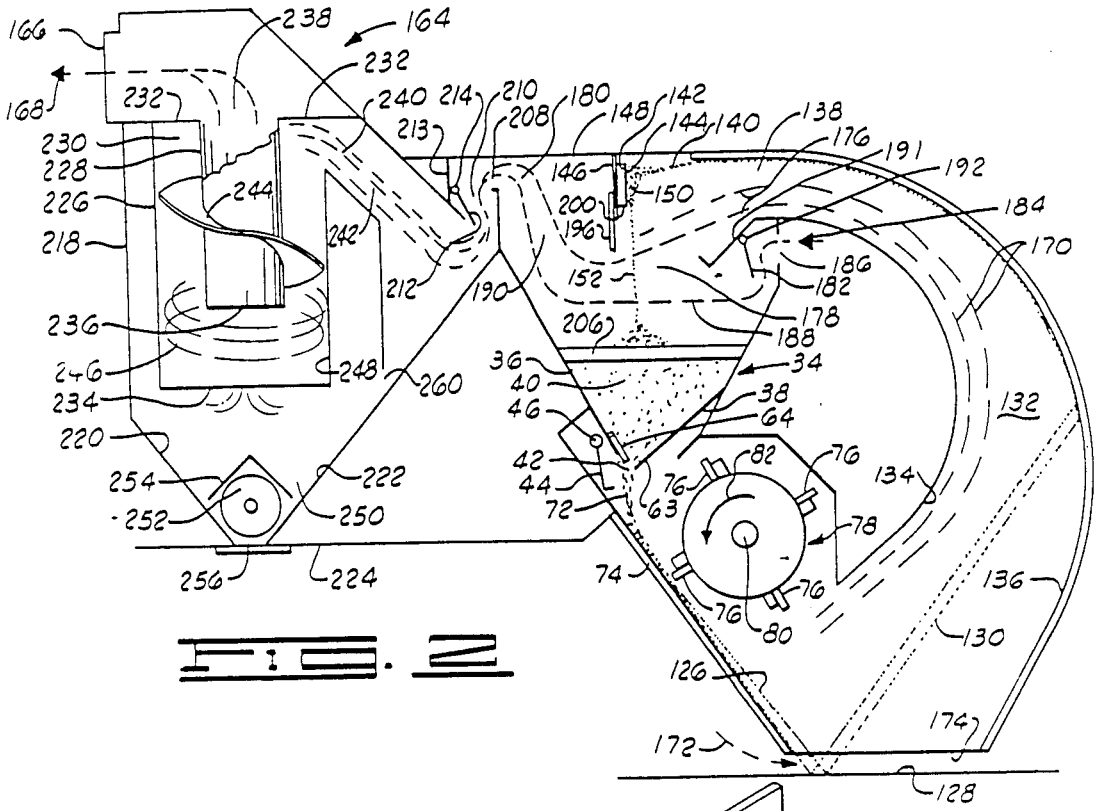
FIG. 2 is a cross-sectional schematic showing the path of abrasive and air through the apparatus.

Referring now to the cross-section of the apparatus shown in FIG. 2, an abrasive storage compartment 34 is formed in part by slanted walls 36 and 38 in which is stored abrasive 40 composed of steel shot or the like. At a lowermost portion of the abrasive storage compartment 34 is an opening 42 which can be opened and closed by a substantially rectangular, flat abrasive flow-control valve 44 which rotates about a hinge 46. The flow-control valve 44 is illustrated in greater detail in FIG. 3 where it is shown in an open position, and in which phantom lines 48 show the valve in a closed position. Attached to hinge 46 is a shaft extension 50 to which is attached a control arm 52. Control arm 52 has a pivotal connection 54 with a stem 56 extending from a hydraulic cylinder 58. The hydraulic pump 27 provides power to hydraulic cylinder 58 to move stem 56 in a linear motion as indicated by arrows 60. As the stem 56 moves, it rotates control arm 52 and shaft 50 about the center line of shaft 50. This rotary motion, indicated by arrows 61, in turn rotates abrasive flow-control valve 44 about hinge 46 to open or close said control valve 44. The arrangement of the hydraulic cylinder 58, stem 56, control arm 52 and control valve 44 are also illustrated in FIG. 5. Extending perpendicular from control valve 44 is a lip 62, which extends under a lower surface 63 of slanted wall 38 to form a seal preventing abrasive flow when the valve 44 is in the closed position.

Figure 3:
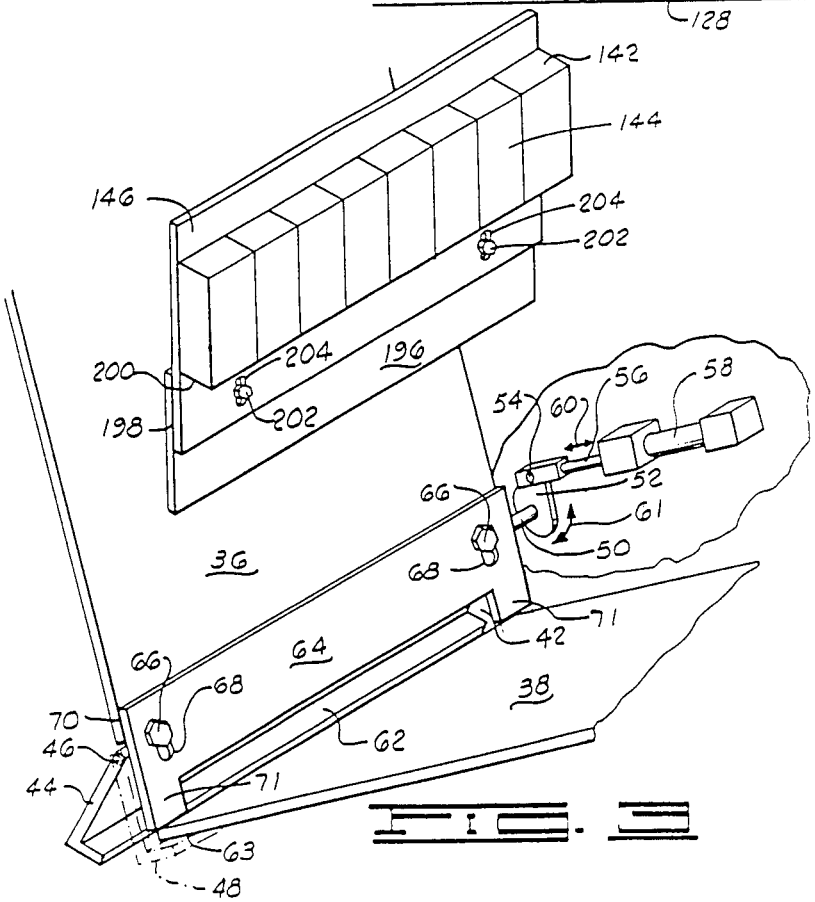
FIG. 3 is an isometric view of abrasive storage compartment with control and abrasive receiving magnets.

The size of flow opening 42 can be changed by a removable and replaceable flow-opening adjusting plate 64 best illustrated in FIGS. 2 and 3. Bolts 66 extend through slots 68 in adjusting plate 64 and are threadingly engaged to wall 36 and tightened to hold adjusting plate 64 in fixed parallel contact with wall 36 along surface 70. Adjusting plate 64 includes a downwardly extending leg 71 on each end thereof in contact with wall 38 and which prevents abrasive from escaping along the ends of control valve 44. Alternate embodiments of removable and replaceable adjusting plate 64 include varying widths of legs 71 which result in different horizontal widths of opening 42, providing abrasive flow control. As the horizontal width of opening 42 is reduced, a narrower abrasive stream 72 is struck by wheel assembly 78, resulting in a horizontally narrower abrasive stream 126 directed toward surface 128. Abrasive stream 126 spreads horizontally such that it impacts surface 128 with a blast pattern that is heavy at the center and gradually lighter toward each end. A further embodiment (not shown) of plate 64 defines a plurality of horizontally spaced openings 42 to provide a plurality of blast patterns on surface 128.

Referring again to FIG. 2, the abrasive 40 gravitationally flows through opening 42 in a downward stream 72 when abrasive flow-control valve 44 is opened. Abrasive stream 72 strikes and slides along abrasive feed plate 74. The abrasive sliding along plate 74 is struck by blades 76 attached to a substantially cylindrical abrasive batting-type blasting wheel assembly 78. The wheel assembly 78 rotates at high speed about a centroidal axial shaft 80 in the direction indicated by arrow 82. Shaft 80 is rotated by a hydraulic motor 83 powered by hydraulic pump 27 as shown in FIG. 5.

Figure 4:
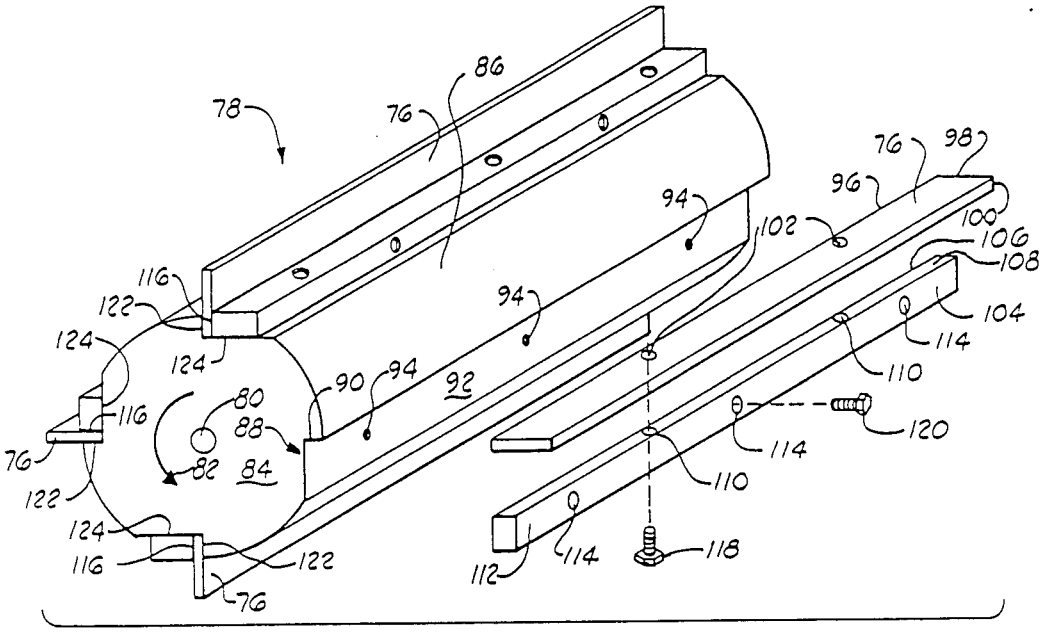
FIG. 4 is an isometric detail of abrasive batting-type wheel assembly.

A preferred embodiment of the abrasive batting-type wheel assembly 78 is shown in FIG. 4. The assembly is formed by a substantially cylindrical rotor 84 to which are attached the blades 76 made of hardened tool steel or the like. An outside diametrical surface 86 is interrupted by a plurality of notches 88 formed by a first radial surface 90 and a second surface 92 extending perpendicular from radial surface 90 to intersect diametric surface 86. Surface 92 defines a plurality of threaded holes 94. Blades 76 are of parallelepiped shape having an axial length indicated by an edge 96, a height indicated by an edge 98 and a thickness indicated by an edge 100, the height being at least two times greater than the thickness. A plurality of threaded holes 102 extend through the thickness of each blade, parallel to edge 100. For each blade 76 there is at least one blade holder 104 of parallelepiped shape having an axial length indicated by an edge 106 and a substantially square cross-section with a surface 108 parallel to the height of blade 76. A plurality of holes 110 extend through each blade holder 104 perpendicular to surface 108. Holes 110 in blade holder 104 correspond to threaded holes 102 in blade 76. Perpendicular to surface 108 of each blade holder 104 is surface 112. Another series of holes 114 passes through blade holder 104 perpendicular to surface 112, said holes 114 corresponding to holes 94 in surface 92 of rotor 84. Each blade holder 104 is attached in parallel contact along surface 116 to a blade 76 by passing bolts 118 through holes 110, threading into holes 102. Each assembly formed by a blade holder 104 and blade 76 is attached to rotor 84 by passing bolts 120 through holes 114, threading into holes 94, such that a height surface of the blade 76 is in parallel contact along surface 122 with a first radial surface 90 of a notch 88, and the blade holder 104 and an edge surface 100 of each blade 76 is in parallel contact along surface 124 with the second surface 92 of a notch 88.

Referring again to FIG. 2, abrasive feed plate 74 is made of hardened steel or the like to minimize wear, and is slanted such that the abrasive struck by rotating blades 76 moves in a high velocity stream 126 toward a surface 128 which is to be treated, said abrasive stream 126 impacting said surface 128 with great force at an acute angle. The abrasive rebounds from surface 128 at an acute angle similar to its angle of incidence on the surface. Carried with this rebounding stream 130 is surface debris.

A detachable and replaceable rebound corridor 132 is defined by curved walls 134 and 136. Wall 136 is made of hardened steel plate or the like. The rebounding stream 130 of abrasive strikes wall 136, further rebounding along wall 136 until it leaves the rebound corridor 132 through exit opening 138, said abrasive and debris forming a substantially horizontal stream 140. As shown in FIGS. 2 and 3, positioned in the path of this high velocity stream 140, and directly above abrasive storage compartment 34, are a plurality of magnets 142 having a forwardly facing vertical face 144. Magnets 142 are attached to a vertical plate 146 attached to an upper surface 148 of main body portion 10. Vertical plate 146 can be made from steel or the like so that magnets 142 can be attached at any point along the surface thereof. Stream 140 strikes face 144 of magnets 142 such that a quantity of the ferrous abrasive forms an envelope 150 therearound. As stream 140 strikes envelope 150 the high velocity abrasive and debris loses kinetic energy, gravitationally falling in a substantially vertical curtain 152 toward the abrasive storage compartment 34. Envelope 150 also protects magnets 142 from excessive wear.

An enclosed dust collector 164 is mounted in the main body portion 10 to the rear of abrasive storage compartment 34 and magnets 144 in continuous communication with the exit opening 138 of rebound corridor 132. Air is drawn through an exhaust opening 166, as indicated by arrow 168, by a suction means hereinafter further described. Rotating wheel 78 also acts as an air blower which, combined with said suction means, provides an air flow stream 170 through the rebound corridor 132. The air enters the rebound corridor 132 as indicated by arrow 172 through blast opening 174 adjacent surface 128. Air stream 170 also contains surface debris picked up by the entering air flow 172. The gradually reducing cross-section of rebound corridor 132 compresses the air and debris stream 170 into a narrower stream 176 which leaves the rebound corridor 132 through exit opening 138 entering an abrasive cleaning enclosure 178 which is vertically positioned between magnets 144 and abrasive storage compartment 34 and horizontally positioned between rebound corridor 132 and dust collector 164. This narrower, fast moving air and debris stream 176 passes through the falling abrasive curtain 152 washing surface debris from the abrasive, said stream 176 exiting the abrasive cleaning enclosure 178 through opening 180, thence into dust collector 164.

A fresh air inlet valve 182 allows a stream of fresh air indicated by arrow 184 to enter abrasive cleaning enclosure 178 through opening 186. The air suction means draws the fresh air through abrasive cleaning enclosure 178 in a stream 188 which also passes through the falling abrasive curtain 152, further removing debris from the abrasive, thus providing additional cleaning of the abrasive as it falls toward abrasive storage compartment 34. Fresh air stream 188 mixes with air stream 176 in a rear portion 190 of abrasive cleaning enclosure 178, exiting the enclosure through opening 180.

Fresh air valve 182 is a substantially rectangular flat plate hingedly attached to an end 191 of wall 134 such that it will rotate about pivot shaft 192. Shaft 192 extends through an outer wall 193 of enclosure 178 and is connected to a manually rota n in the side elevation of the apparatus table handle 194 as shown in the side elevation of the apparatus in FIG. 1. Handle 194 can be turned so that fresh air valve 182 can completely close opening 186, thus providing full control of the amount of fresh air 184 which can enter the abrasive cleaning enclosure 178.

The direction of flow of air streams 176 and 188 can be altered inside abrasive cleaning enclosure 178 by means of a vertically adjustable baffle plate 196 which is best illustrated in FIGS. 2 and 3. Baffle plate 196 is attached in parallel contact to vertical plate 146 along surface 198 adjacent a lower side 200 of magnets 142. Bolts 202 pass through slots 204 in vertical plate 146 and are threaded into corresponding threaded holes (not shown) in baffle plate 196. Baffle plate 196 and bolts 202 can be vertically adjusted to a pre-determined position, then fixedly attached to vertical plate 146 by tightening bolts 202.

The cleaning of falling abrasive curtain 152 by air streams 176 and 188 results in clean abrasive falling into abrasive storage compartment 34. This cleaned abrasive can then be reused by flowing past abrasive control valve 44 toward batting wheel assembly 78. Occasionally, heavy debris such as rocks or the like, which cannot be carried away by air streams 176 and 188, will pass upward through rebound corridor 132 in abrasive flow 130. To prevent such large debris from entering the abrasive storage compartment a horizontal filtering screen 206 is used to separate cleaning enclosure 178 and abrasive storage compartment 34 which allows the relatively small abrasive to pass through while preventing further movement of large debris.

Combined air and debris stream 208 exits abrasive cleaning enclosure 178 through opening 180 then enters dust collector 164 through an inlet opening 210. The flow through opening 210 can be variably adjusted by system air control valve 212 which is a substantially flat plate similar to fresh air inlet valve 182. Control valve 212 is hingedly attached to vertical panel 213 extending downward from upper surface 148 such that valve 212 will rotate about pivot shaft 214 which extends through an outer wall 215 of dust collector 164 and is attached to a handle 216 as best shown in FIG. 1. Handle 216 can be manually rotated to vary the flow rate of air and debris through opening 210, thus also controlling the total amount of air 172 entering the rebound corridor and fresh air 184 entering the apparatus.

Referring to FIG. 2, dust collector 164 is generally formed by a vertical wall 218 and two slanted walls 220 and 222 which are at opposite acute angles to a lower surface 224. Inside dust collector 164 are a first large cylinder 226 and a smaller concentric cylinder 228 disposed therein. An annu-lus 230 formed between cylinders 226 and 228 is closed at an upper end by a horizontal panel 232. A lowermost open end 234 of large cylinder 226 extends below an open lower end 236 of small cylinder 228. An open upper end of small cylinder 228 communicates with exhaust opening 166 through passageway 238. An upper forward facing side of large cylinder 226 has an opening 240 communicating with control valve 212 via angular duct 242. Installed in annulus 230 is a stationary spiral baffle 244.

As the air and debris mixture 208 enters dust collector 164 through inlet opening 210 it is pulled up angular duct 242 through opening 240 in cylinder 226, thus entering annulus 230 between cylinders 226 and 228. The air and dust mixture must then flow downward through the annulus 230 across spiral baffle 244 which causes the air and debris to cyclonically rotate at high velocity as indicated by 246. The cyclonic rotation forces the debris out toward an inner surface 248 of cylinder 226 by centrifugal force. The debris then loses kinetic energy and falls toward slanted walls 220 and 222, sliding into a lower V-shaped portion 250 of dust collector 164. This process removes large debris and dust particles from the air. The relatively clean air, containing only remaining fine dust then rises through the inside of small cylinder 228, through passageway 238 and out exhaust opening 166 in a stream indicated by arrow 168.

A rotating auger 252 driven by a hydraulic motor (not shown) is located in the lowermost portion of dust collector 164 between slanted walls 220 and 222. A deflector 254 is placed immediately above auger 252 to prevent dust and debris from building up on top of it. As the auger 252 rotates, it forces the built up dust out of dust collector 164 through dust dump opening 256 where it can be collected or discarded as desired. As shown in FIG. 1, a door 258 is provided in main body portion 10 ihto dust collector 164 for access to auger 252 and further dust removal. Heavier debris which does not travel with the air stream up angular duct 242 is free to slide down slanted wall 222 past an opening 260 toward the lower portion 250 of dust collector 164.

Referring again to FIG. 1, a trailer hitch 262 is mounted on the lowermost rear portion of main body portion 10. Removably attached to hitch 262 is a trailer yoke 264 which is further attached to a towable trailer assembly 266 mounted on wheels 268. Trailer assembly 266 has an air inlet opening 269 which is maintained in communication with exhaust opening 166 of dust collector 164 by means of a flexible hose 270. Installed inside of trailer 266 is an air suction fan 271 providing the suction means hereinabove mentioned which pulls air through the entire blasting apparatus in the manner previously described. As the air travels into trailer 266 as indicated by arrow 272, it passes through at least one filter cartridge 273 which removes the remaining dust, resulting in a clean air stream 274 entering suction fan 271.

In an alternate embodiment of the apparatus, the trailer assembly 266 is omitted. In this embodiment, an exhaust filter assembly 275, shown in phantom lines, is mounted directly to exhaust opening 166 of dust collector 164. Filter assembly 275 contains a suction fan (not shown) to provide the air suction means. This embodiment is useful when further filtering of the air stream exiting dust collector 164 is not required.

Mounted on the lower rear portion of trailer 266 is a magnetic roller 276 which can pick up spent abrasive which does not rebound up into rebound corridor 132. As roller 276 rotates, the attached abrasive is removed by a scraper 278 and then falls into a collection tray 280. The abrasive thus recovered can be reused.

Occasionally, the blasting apparatus may pass over a discontinuity in the surface 128 to be treated such as a hole or the like. When this occurs abrasive will not rebound properly through rebound corridor 132 and may bounce from the discontinuity with great velocity. To help prevent escape of such abrasive a seal 282 is provided on the apparatus between blast opening 174 and the surface 128. Seal 282 includes flexible lips 284 along each side and a flexible lip 286 along a front side of blast opening 174. Each flexible lip 284 is mounted in a vertically movable bracket 288 biased toward surface 128 by springs 290 mounted on outer side wall 292 of rebound corridor 132.

To provide further protection for the operator and bystanders from forwardly rebounding abrasive, an optional substantially rectangular flap 294 is mounted to a forward end 296 of rebound corridor 132 by means of bracket 298. Flap 294 has an upwardly curving front portion 300 so that it will easily slide along surface 128. Abrasive that is thrown forward will bounce off of the lower surface 302 of flap 294, thus losing kinetic energy and falling harmlessly to surface 128 where it can be later picked up by magnetic roller 276 or similar means. Flap 294 is connected to bracket 298 by a hinge 304 so that it can be lifted above surface 128 when not in use, as indicated by phantom lines 306. A latch 308 holds flap 294 in this upward position.

Figure 7:
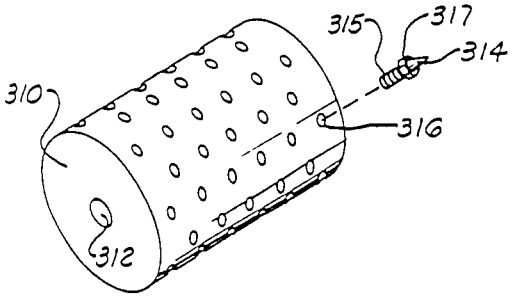
FIG. 7 is an isometric detail of weighted rotor with spikes for puncturing durable surface coatings.
Figure 8:
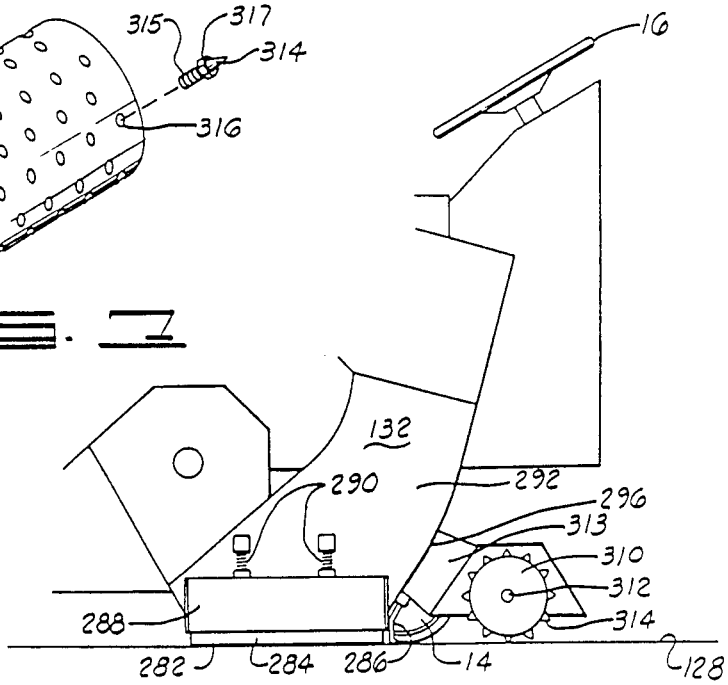
FIG. 8 is a detail elevation of forward end of apparatus showing weighted rotor with spikes for puncturing durable surface coatings.

Some surface coatings such as epoxy street or highway marking lines are extremely difficult to remove. The normal blasting by the abrasive is frequently inadequate, and the alternate embodiment shown in FIGS. 7 and 8 provides a method of removing such difficult surface coatings. A weighted cylindrical roller 310 which rotates about its central axis 312 is attached to a forward end 296 of rebound corridor 132 by mounting bracket 313. Attached to a diametrical surface of roller 310 are a plurality of radially outwardly pointing spikes 314. As the roller rolls across the surface coating spikes 314 puncture the coating. These punctures break up the coating sufficiently so that the normal blasting apparatus will then remove it from surface 128. Each spike 316 has an inwardly pointing threaded end 315 which is threadingly engaged in one of a plurality of threaded holes 316 in the diametric surface of roller 310, and hexagonal center portion 317 to be engaged by a wrench or the like.

Referring now to FIG. 5, front wheel 14 is mounted on a truck 318 fixed to a steering shaft 320 which turns in bearings 322. Bearings 322 are mounted on a block 324 which is at a fixed height above surface 128. The gap between blast opening 174 and treated surface 128 can be adjusted by raising or lowering the entire blaster apparatus by use of a hydraulic cylinder 325 remotely controlled by one of levers 20. The vertically adjustable seal 282 compensates for this difference in height above the surface 128. Thus, the blasting apparatus can be set at various heights to compensate for irregularities in surface 128.

Figure 6:
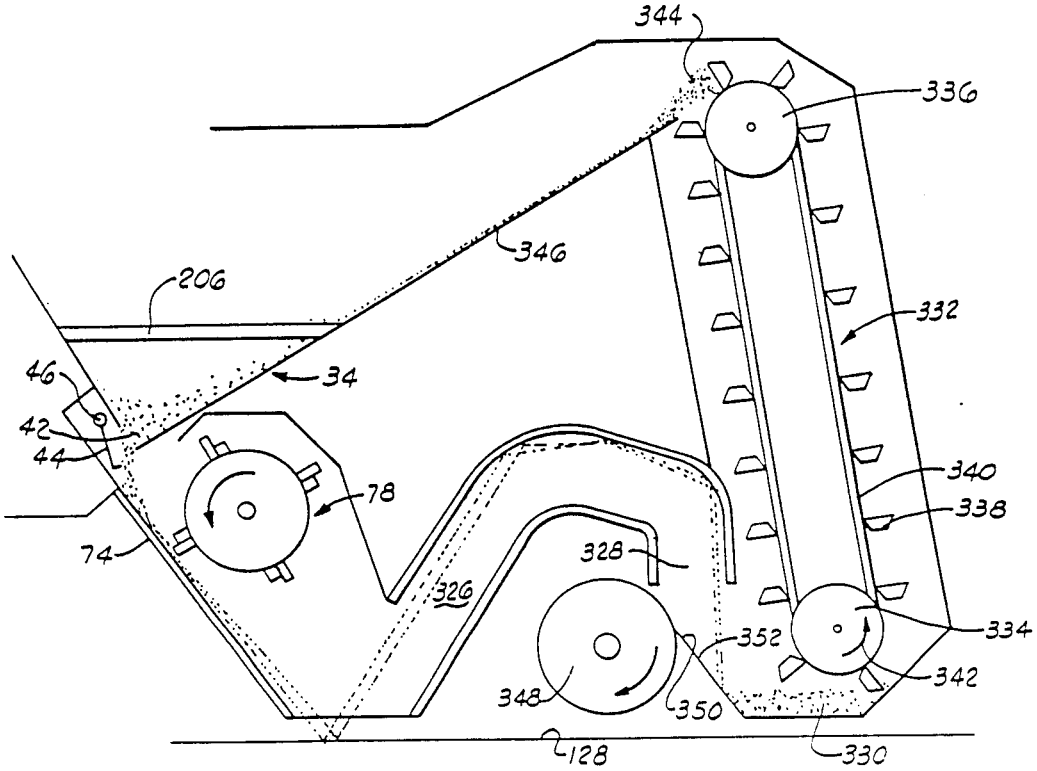
FIG. 6 is a sectional schematic showing an alternate abrasive recovery method.

Referring now to FIG. 6, an alternate method of recovering abrasive from surface 128 is disclosed which does not utilize a rebound corridor 132. In this embodiment there is again an abrasive storage compartment 34 which allows abrasive to gravitationally flow through an opening 42 controlled by an abrasive flow-control valve 44. The abrasive falls down an angular abrasive feed plate 74 to be thrown to the surface 128 by abrasive batting wheel assembly 78 in the manner hereinbefore described. The abrasive rebounds from surface 128 up into a rebound channel 326 which curves forwardly and downwardly. The abrasive is discharged from channel 326 through an opening 328 where it falls into an abrasive receiving compartment 330. A belt conveyor 332 having a lower pulley 334 and an upper pulley 336 is used to pick up the abrasive in compartment 330. A plurality of conveyor buckets 338 attached to an endless belt 340 rotating in the direction indicated by arrow 342 lift the abrasive in compartment 330, carrying it upward. As the buckets reach the top of pulley 336 the abrasive is projected in a stream 344 where it then falls toward abrasive storage compartment 34 along surface 346. As in the embodiment previously described, a filter screen 206 is provided above storage compartment 34 to separate large debris from the abrasive. It will be obvious to those skilled in the art that a fresh air cleaning method as hereinbefore described also can be incorporated in this embodiment of the apparatus. A rotating cylindrical magnetic drum 348 is installed to pick up abrasive which is thrown forward and carried through rebound channel 326. The abrasive attached to drum 348 is removed by a scraper 350 and then slides dowh angular surface 352 into the abrasive receiving compartment 330.

Although a preferred embodiment of the invention has been illustrated herein in order to provide an understanding and comprehension of the basic principles which underlie the invention, it will be understood that various changes and modifications can be effected without departure from said basic principles. Changes and innovations of that type are therefore deemed to be circumscribed by the spirit and scope of the invention as defined by the appended claims or reasonable equivalents thereof.

What is claimed is:

1. In a surface blasting apparatus having abrasive projecting means to project abrasive toward a surface to be treated, said abrasive projecting means including a rotating wheel adapted to propel abrasive falling into contact with the wheel along a line parallel to the rotational axis of the wheel into a curtain extending substantially parallel to that rotational axis and against the surface to be treated, the improvement which comprises a abrasive flow-control system acting in cooperation with said abrasive propelling wheel, and comprising:

an abrasive storage compartment with a lowermost portion defined by a pair of sloping walls each have inclined surfaces which are inclined at an acute angle to the vertical, and which walls converge at thier lower ends to define a flow opening therebetween;

a flow-control valve positioned adjacent said flow opening and movable to open and close said opening, said valve including:

a substantially monoplanar, elongated, substantially horizontally extending main portion which is at least equal, in size to said flow opening; and a substantially monoplanar, elongated, substantially horizontally extending lip extending perpendiular to said main portion, at one side thereof, said lip being extendible under and into juxtaposition to one of said sloping walls to form a seal preventing abrasive flow from said storage compartment when the valve is in the closed position and said main portion is adjacent the other one of said sloping walls, said main portion and lip forming together an elongated, horizontally extending, abrasive-receiving angle from which abrasive particles will fall in a gravitating curtain of uniform particle density over the transverse width of the curtain;

a hinge hingedly and pivotally attaching one side of said main portion to said storage compartment for pivotation. about a horizontal axis for retaining said main portion and the lip extending therefrom in a horizontally extending status, whereby a closed position of the value is defined when said valve is pivoted to, and covers, said flow opening, said hinge being disposed along the opposite side of said main portion from the side of said main portion from which said lip projects substantially perpendicular to said main portion;

means for rotating, in a selectively variable fashion, said valve about said hinge and toward and away from said flow opening, thus defining a variable open position of said valve, said variable open position allowing a priportionate amount of abrasive to gravitationally flow through said flow opening, said rotating means comprising:

a shaft attached to the main portion of said flowcontrol valve; and actuation means to rotate said shaft about said hinge to open and close said valve, said actuation means comprising a remotely controlled power cylinder; and a detachable plate adjustably attached to one of the slanted walls of said abrasive storage compartment above said flow-control valve and defining an internal opening of predetermined size through said plate, which internal opening has a width less than a width of said flow opening between said sloping walls to thereby restrict the width of abrasive flowing through said opening and to ultimately restrict the width of said curtian, said detachable plate thus controlling the rate and pattern by which abrasive is projected from said wheel toward said surface to be treated, said plate being interchangeable with other plates of different configurations from said first mentioned plate to provide selectively predetermined flow patterns of abrasive through said opening in said other plates and into contact with said abrasive propelling wheel, whereby a selectively wider or a narrower curtain of abrasive may be gravitated onto said abrasive propelling wheel.

2. The improvement in the surface blasting apparatus defined in claim 1 wherein said detachable plate includes downwardly extending legs projecting downwardly from the opposite ends thereof in contact with said one wall of the abrasive storage compartment for thereby preventing abrasive from escaping along the ends of the control valve, and for narrowing the width of the abrasive curtain gravitated onto said abrasive Propelling wheel, and therefore the width of the curtain of abrasive thrown from said wheel against the surface to be treated; and wherein said improvement further includes:

slots formed in said detachable plate; and bolts extending through said slots into said one slanted wall upon which said detachable plate is mounted, with said bolts being loosenable to permit said detachable plate to be adjusted to widen or narrow said flow opening between the convergent lower ends of said sloping walls of said storge compartment.

* * * * *

UNITED STATES PATENT AND TRADEMARK OFFICE

CERTIFICATE OF CORRECTION

PATENT NO. : 4,693,041

DATED : September 15, 1987

INVENTOR(S) : Wayne E. Dickson

It is certified that error appears in the above-identified patent and that said Letters Patent are hereby corrected as shown below:

In the Abstract:

In line 6, after "ing" delete "member" and insert -means-.

In line 12, after the word "by" insert -means of-.

In the Specification:

In Column 2, line 45, delete the last word "tO" and insert -to-.

In Column 2, line 64, after the word "control" insert -valve-.

In Column 2, line 68, after the word "of" insert -the-.

In Column 6, line 9, delete "rota" and insert -rotatable handle 194 as shown-.

In Column 6, line 10, delete " n".

In Column 6, line 62, delete "annu-lus" and insert -annulus-.

In Column 7, line 31, delete "ihto" and insert -into-.

In Column 9, line 19, delete "dowh" and insert -down-.

In the Claims:

In Column 9, line 42, delete "a" and insert -an-.

In Column 10, line 8, delete "value" and insert -valve-.

In Column 10, line 18, delete "priportionate" and insert -proportionate-.

In Column 10, line 35, delete "curtian" and insert -curtain-.

UNITED STATES PATENT AND TRADEMARK OFFICE

CERTIFICATE OF CORRECTION

PATENT NO. : 4,693,041

DATED : September 15, 1987

INVENTOR(S) : Wayne E. Dickson

It is certified that error appears in the above-identified patent and that said Letters Patent is hereby corrected as shown below:

In Column 10, line 54, delete "Propelling" and insert -propelling--.

Signed and Sealed this

Twenty-sixth Day of April, 1988

*Attest:*

DONALD J. QUIGG

*Attesting Officer*

*Commissioner of Patents and Trademarks*